US006619256B2

(12) United States Patent
Morgillo et al.

(10) Patent No.: US 6,619,256 B2
(45) Date of Patent: Sep. 16, 2003

(54) PISTON ENGINE

(75) Inventors: Ivano Morgillo, Bieringen (DE); Jürgen Müller, Schwäbisch Gmünd (DE); Jochen Roos, Remseck-Neckarrems (DE); Martin Rosenbecker, Schwülper (DE); Günter Kachler, Ingersheim (DE); Hans Gebert, Heilbronn (DE); Hans-Peter Drespling, Heidenheim (DE); Jürgen Stehlig, Neckartailfingen (DE)

(73) Assignee: Mahle Filtersysteme GmbH, Stuttgart (DE)

( * ) Notice: Subject to any disclaimer, the term of this patent is extended or adjusted under 35 U.S.C. 154(b) by 0 days.

(21) Appl. No.: 10/168,732

(22) PCT Filed: Dec. 21, 2000

(86) PCT No.: PCT/DE00/04579

§ 371 (c)(1),
(2), (4) Date: Nov. 8, 2002

(87) PCT Pub. No.: WO01/48368

PCT Pub. Date: Jul. 5, 2001

(65) Prior Publication Data

US 2003/0106525 A1 Jun. 12, 2003

(30) Foreign Application Priority Data

Dec. 24, 1999 (DE) ..... 199 62 987

(51) Int. Cl.[7] ..... F02M 55/00; F02M 41/00
(52) U.S. Cl. ..... 123/336; 123/469; 123/456
(58) Field of Search ..... 123/336, 468, 123/469, 470, 456

(56) References Cited

U.S. PATENT DOCUMENTS

| | | | | | |
|---|---|---|---|---|---|
| 4,771,751 | A | * | 9/1988 | Haigh et al. | 123/470 |
| 4,909,221 | A | * | 3/1990 | Heuser | 123/470 |
| 5,022,371 | A | * | 6/1991 | Daly | 123/468 |
| 5,111,794 | A | * | 5/1992 | DeGrace, Jr. | 123/470 |
| 5,261,375 | A | | 11/1993 | Rush et al. | 123/470 |
| 5,482,021 | A | * | 1/1996 | Roche | 123/456 |
| 5,870,995 | A | | 2/1999 | Stockner et al. | 123/470 |
| 6,148,798 | A | * | 11/2000 | Braun et al. | 123/467 |
| 6,260,537 | B1 | * | 7/2001 | Lamb et al. | 123/456 |
| 6,269,797 | B1 | * | 8/2001 | Uchida | 123/469 |
| 6,405,711 | B1 | * | 6/2002 | Smith et al. | 123/456 |

FOREIGN PATENT DOCUMENTS

| | | |
|---|---|---|
| EP | 0 245 009 | 11/1987 |
| EP | 0 748 934 | 12/1996 |
| FR | 2 779 681 | 12/1999 |

* cited by examiner

*Primary Examiner*—Hieu T. Vo
*Assistant Examiner*—Hai Huynh
(74) *Attorney, Agent, or Firm*—Collard & Roe, P.C.

(57) ABSTRACT

The invention relates to a piston engine comprising an engine block that contains several cylinders. The inventive piston engine also comprises a fresh-gas supply device that is provided with several supply pipes (1) which are arranged on the cylinders and are fixed to the engine block. Said piston engine further comprises a fuel injection system that is provided with a high-pressure supply line (5) which is allocated to the cylinders. The aim of the invention is to fix the supply pipes (1) and the high-pressure supply line (5) to the engine block in a simpler manner. Holding-down clamps (7) for the supply pipes (1) are configured on the high-pressure supply line (5) in such a way that the high-pressure supply line (5) fixes the supply pipes (1) to the engine block.

18 Claims, 3 Drawing Sheets

PISTON ENGINE

CROSS REFERENCE TO RELATED APPLICATIONS

Figure 1:
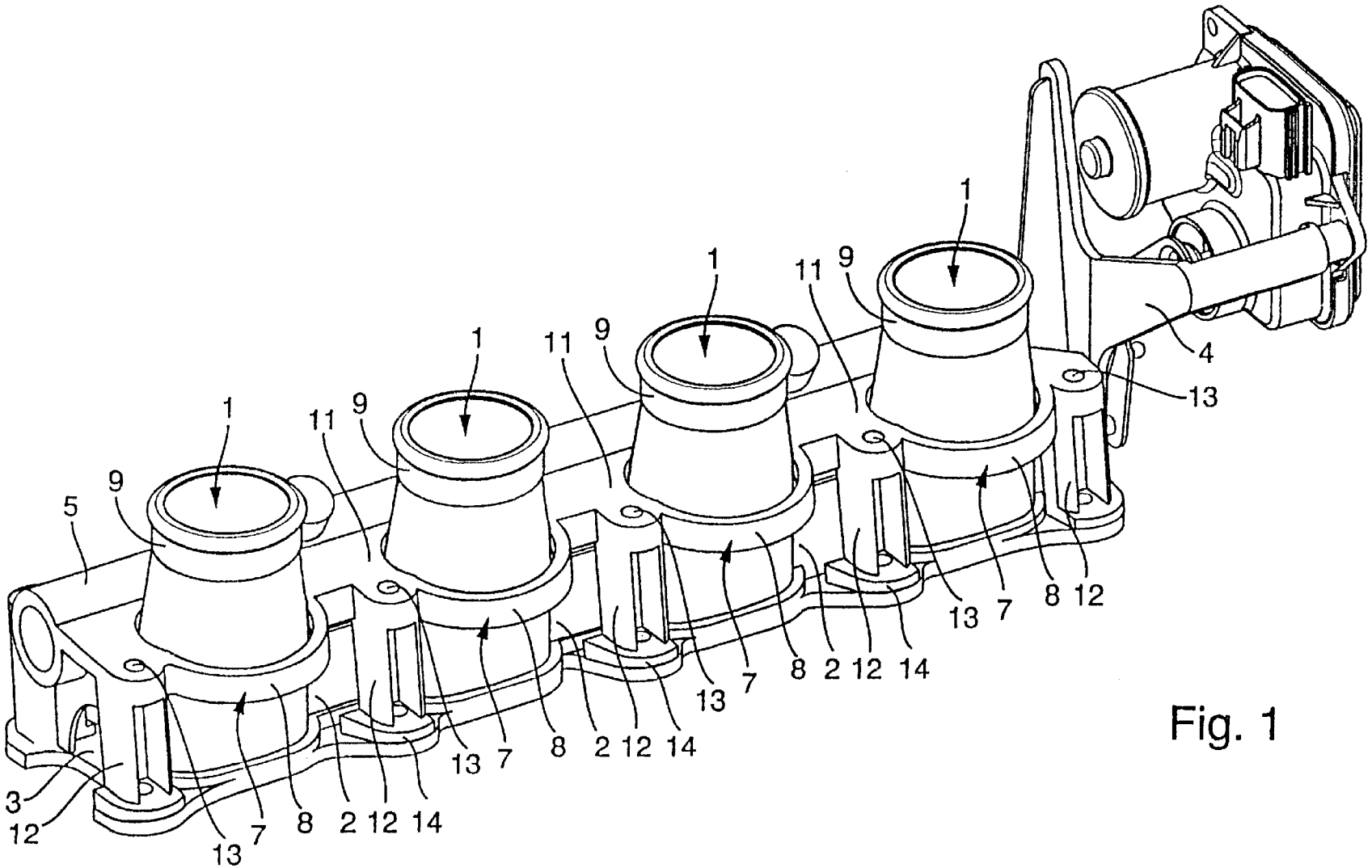

Applicants claim priority under 35 U.S.C. §119 of German Application No. 199 62 987.0 filed Dec. 24, 1999. Applicants also claim priority under 35 U.S.C. §120 of PCT/DE00 0/04579 filed Dec. 21, 2000. The international application under PCT article 21(2) was not published in English.

This invention relates to a piston engine having the features of the preamble of claim 1.

A piston engine has an engine block with several cylinders and is equipped with a fresh gas inlet having several inlet pipes secured on the engine block and allocated to the cylinders. Through this fresh gas inlet, intake air or charging air that is needed for combustion is supplied to the engine. Modern piston engines are equipped with a fuel injection system which has a high-pressure inlet line provided for the cylinders. In such a high-pressure inlet line, the fuel is supplied to the cylinders jointly under a high pressure, and a targeted metering of fuel is accomplished by fuel injectors. Such a common high-pressure inlet line is referred to in general as a "common-rail" injection system.

The high-pressure inlet line is preferably made of metal because of the high fuel pressures. However, plastic is preferred for production of the inlet pipes. Inlet pipes made of plastic are usually mounted on the engine block by means of metal bushings which are welded or fused into a flange section of the inlet pipes to make it possible to screw the inlet pipes onto the engine block. The high-pressure inlet line may be mounted directly on the engine block or on the inlet pipes and thus indirectly on the engine block. It is likewise possible to manufacture the inlet pipes and the high-pressure inlet line in one part of metal, whereby this integral module is then mounted on the engine block by means of a corresponding screw connection.

The present invention is concerned with the problem of designing a piston engine of the type defined in the preamble in such a way as to simplify the mounting of the high-pressure inlet line and the inlet pipes.

This problem is solved according to this invention by a piston engine having the features of claim 1.

This invention is based on the general idea of designing the high-pressure inlet line so that it cooperates with the inlet pipes to the extent that the inlet pipes are mounted on the engine block simultaneously by the mounting of the high-pressure inlet line. Due to this measure, additional fastening means for mounting the inlet pipes on the engine block may be omitted. In particular, it is possible in this way to manufacture the inlet pipes of plastic without having to integrate additional fastening elements made of metal into them. Thus, on the whole this yields an especially economical method of manufacturing the proposed combination of inlet pipes and the high-pressure inlet line.

Additional important features and advantages of the device according to this invention are derived from the subclaims, the drawings and the respective description of the figures on the basis of the drawings.

It is self-evident that the features mentioned above as well as those to be explained below can be used not only in the given combination but also in any other combinations or even alone without going beyond the scope of the present invention.

A preferred embodiment of this invention is illustrated in the drawings and explained in greater detail in the following description.

Figure 2:
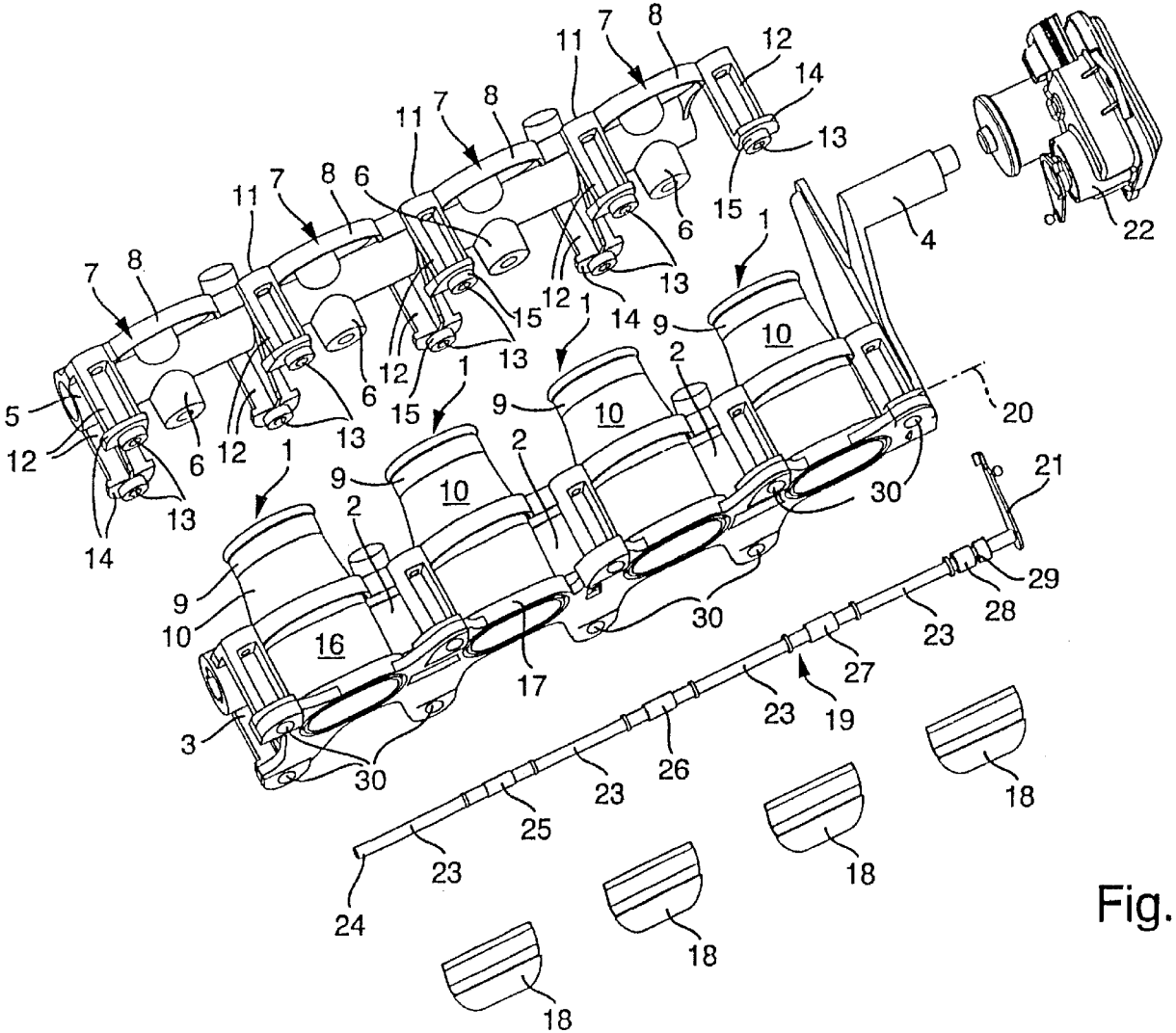
Figure 3:
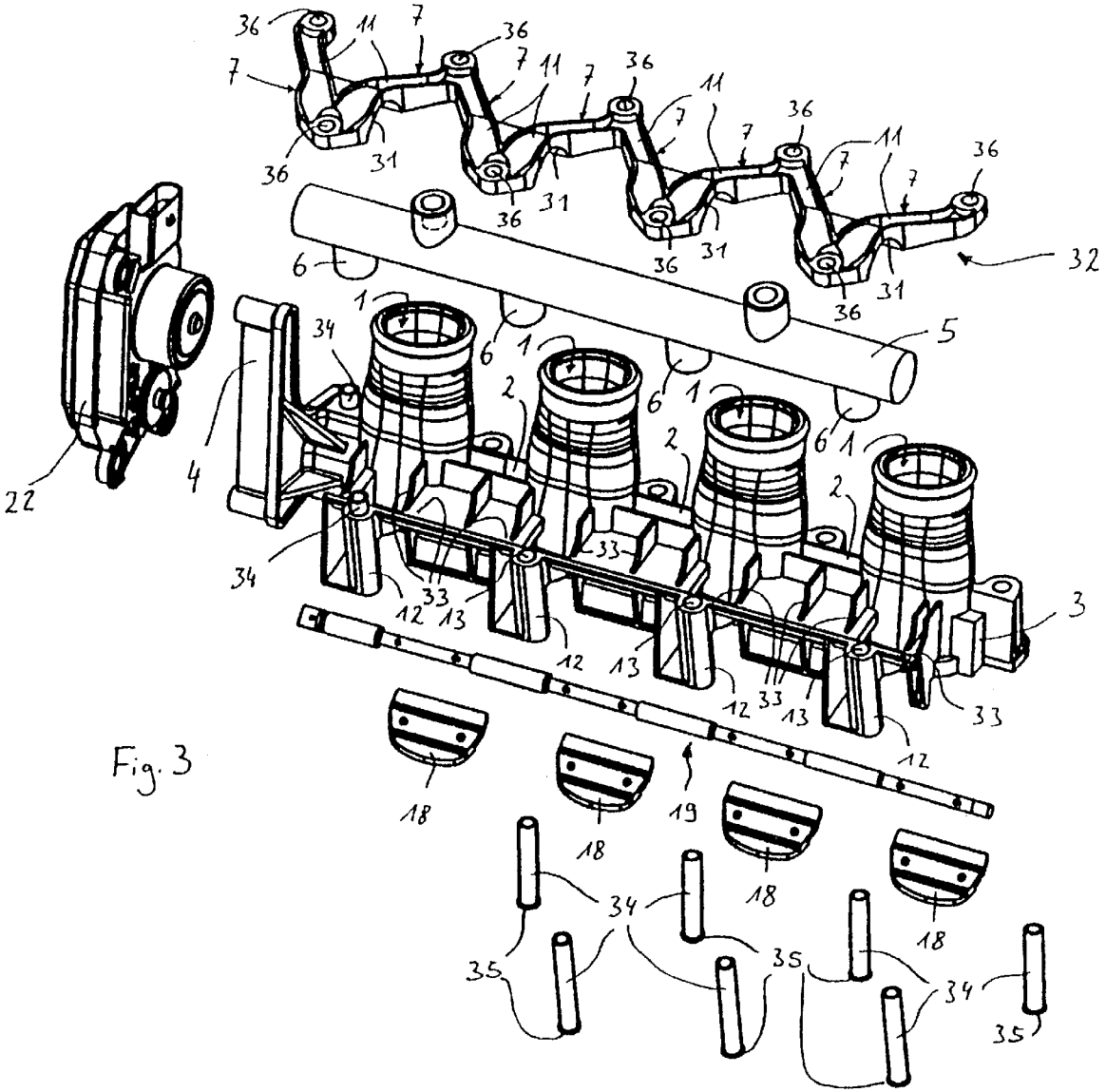

The figures show schematically:

| | |
|---|---|
| FIG. 1 | a perspective view of inlet pipes and a high-pressure inlet line according to this invention, |
| FIG. 2 | an exploded diagram of the arrangement according to FIG. 1, and |
| FIG. 3 | a diagram like that in FIG. 2, but illustrating another embodiment. |

According to FIGS. 1 and 2, a piston engine (not shown otherwise) is equipped with a fresh gas inlet, of which inlet pipes 1 are shown here, representing the end of the fresh gas inlet allocated to the engine and each supplying the fresh gas to one cylinder of the piston engine. Two adjacent inlet pipes 1 are attached to one another by a common connecting web 2.

Inlet pipes 1 are preferably arranged in a row. Since four inlet pipes 1 are shown here, the respective piston engine is designed accordingly as an in-line four-cylinder engine or as a V-8 engine.

A bearing strip 3 is integrally molded on one of the exterior inlet pipes 1. A support 4 is integrally molded on the other exterior inlet pipe 1. The inlet pipes 1, the connecting webs 2, the bearing strip 3 and the support 4 are preferably combined in one injection molded part and are preferably made of a suitable plastic.

The piston engine also has a fuel injection system, of which a high-pressure inlet line 5 is shown here, supplying fuel to fuel injectors (not shown) with connections 6. Since the fuel in high-pressure inlet line 5 is under a high working pressure, the high-pressure inlet line 5 is preferably manufactured in a metal construction, in particular by a die-casting method. A holding-down clamp 7 having a retaining ring 8 is provided for each inlet pipe 1 on the high-pressure inlet line 5. Each of these retaining rings 8 is shaped so that the respective inlet pipe 1 can be inserted into it with an upper section 9 and comes to rest on it in a central section 10 which has a widened cross section. The interior contour of the retaining ring 8 is preferably adapted to the exterior contour of the central section 10 so that a large area of contact can develop between the retaining ring 8 and inlet pipe 1.

Between adjacent retaining rings 8, the holding-down clamps 7 have retaining webs 11 which come to rest with a bottom side on a top side of the connecting webs 2, when the retaining rings 8 set on the central sections 10 of the inlet pipes 1. Here again, a large area of contact between the retaining webs 11 and the connecting webs 2 is preferred.

Several supporting feet 12 are provided on the high-pressure inlet line 5 and on the holding-down clamps 7, each having an inside passage 13 for a screw in its interior. The high-pressure inlet line 5, the holding-down clamps 7 and the supporting feet 12 are preferably designed as a one-piece component which can be manufactured by a die-casting method, for example. On their lower end facing the engine block (not shown), the supporting feet 12 each have a supporting plate 14 which comes to rest on a flange 17 which is provided on the end of the inlet pipes 1 facing the engine block. Cylinder bushings 15, which are inserted into complementary receptacles 30 in the flange 17, project downward from this supporting plate 14. The cylinder bushings 15 are designed with dimensions such that the supporting plate 14 exert a pressure on the flange 17 when the supporting feet 12 are screwed onto the engine block.

For fastening the high-pressure inlet line 5 and the inlet pipes 1 on the engine block, screws of the proper size are then inserted into inside passages 13 and screwed onto the engine block, yielding a high-strength connection between the supporting feet 12 and the engine block. Since the high-pressure inlet line 5 is connected to the supporting feet 12, this also achieves the mounting of the high-pressure inlet line 5 on the engine block. In addition, the dimensioning of a lower section 16 of the inlet pipes 1 is selected so that the inlet pipes 1 are secured on the engine block with a sufficient pressure on the end facing the engine block when the high-pressure inlet line 5 is screwed onto the engine block with its supporting feet 12. No additional fastening elements for mounting the inlet pipes 1 on the engine block are needed. It is clear that suitable sealing means are provided at complementary locations in the flange 17 and/or in the engine block to supply optionally supplied fresh gas without leakage to the cylinders of the piston engine.

According to FIG. 2, a throttle valve 18 is assigned to each inlet pipe 1. These throttle valves are accommodated in the interior of the respective inlet pipe 1 and serve to adjust the opening cross section of the inlet pipes 1. To this end, the throttle valves 18 are mounted in a rotationally fixed manner on a common drive shaft 19 which projects through the inlet pipes 1, the connecting webs 2 and the support 4, if these are inserted into it, approximately at the level of a dash-dot line 20. On its end allocated to the support 4, the drive shaft 19 has an actuating lever 21 which cooperates with an actuator 22 which can be mounted on the support 4.

For each throttle valve 18, the drive shaft 19 has a valve section 23 which extends axially as well as several bearing sections 24, 25, 26, 27, 28 which also extend axially, and two of them border axially one valve section 23. According to the special design illustrated here, the valve sections 23 each have the same diameter. The bearing section 24, which is formed on the axial end of the drive shaft 19 facing away from the actuating lever 21, preferably has a diameter which is equal to or less than the diameter of the adjacent valve section 23. In contrast with that, the diameters of the other bearing sections 25, 26, 27, 28 are each larger than the diameter of the valve sections 23. In addition, the bearing sections 24 through each have a constant diameter, whereby the diameters of the bearing sections 24 through differ from one another such that the diameter becomes larger along the drive shaft 19 in the direction of the actuating lever 21. Accordingly, the bearing section 24 formed on the end facing away from the actuating lever has the smallest diameter, while the bearing section provided on the end facing the actuating lever has the largest diameter.

In the bearing strip 3 and in the connecting webs 2 as well as in the support 4, bearing openings (not visible here) are formed coaxially with line 20, these openings being complementary to the bearing sections 24 through 28, so that the drive shaft 19 can be inserted coaxially with the dash-dot line 20 into the module of inlet pipes 1, connecting webs 2, bearing strip 3 and support 4. It is clear that with regard to their diameter, these bearing openings are coordinated with the diameters of the bearing sections 24 through so that the drive shaft 19 is pivotably adjustable on the one hand while on the other hand a sufficient seal can be guaranteed between the individual inlet pipes 1. Only in the case of the bearing section which is assigned to the end of the drive shaft having the actuating lever may additional sealing means also be provided. For example, this bearing section has a ring groove 29 into which may be inserted an O ring, for example. The bearing opening contained in the bearing strip 3 is designed so it is closed on one end for a hermetic seal, so that the respective bearing section 24 penetrates axially into this bearing opening.

This design of the drive shaft 19 described above simplifies combining the inlet pipes 1, the connecting webs 2, the bearing strip 3 and the support 4 into one injection molded part, because a mandrel of the injection mold can be designed like the drive shaft 19 and therefore it can be removed especially easily from the component after injection molding. In addition, this simplifies the introduction of the drive shaft 19 into the injection molded part.

FIG. 3 shows another embodiment of this invention, which differs essentially from the embodiment illustrated in FIGS. 1 and 2 in that the holding-down clamps 7 and the high-pressure inlet line 5 are not designed as one part but instead they are separate parts. All the holding-down clamps 7 are combined into a one-piece holding-down component 32. In this special embodiment, the holding-down clamps 7 are designed without the retaining ring 8 (see FIGS. 1 and 2), but instead they consist essentially only of the retaining webs 11 which extend beyond the connecting webs 2 for securing the inlet pipes 1. Saddle-shaped seats 31 whose contour is essentially complementary to the outside contour of the high-pressure inlet line 5 are formed on the holding-down clamps 7 and on the holding webs 11 on a side facing the high-pressure inlet line 5. In this way, the holding-down component 32 can be placed on the high-pressure inlet line 5 and can be secured on it. This mounting can be implemented, for example, by a weld or a soldered connection between the holding-down component 32 and the high-pressure inlet line 5. Likewise, the seats 31 may be shaped so that a press fit is formed between the high-pressure inlet line 5 and the holding-down clamps 7 placed thereon or attached thereto.

Due to the separate design of the holding-down clamps 7 and the high-pressure inlet line 5, different manufacturing materials and/or manufacturing methods may be used for the separate components and may be optimized with regard to the respective component function and requirements.

In the embodiment illustrated in FIG. 3, saddle-shaped seats 33 are also formed on the inlet pipes 1 and on the connecting webs 2 on a side facing the high-pressure inlet line 5; the high-pressure inlet line 5 comes to rest in these saddle-shaped seats 33 in installation on the engine block. These seats 33 are also expediently adapted to the outside contour of the high-pressure inlet line 5 with regard to their contour.

In the embodiment according to FIG. 3, the supporting feet 12 are designed on the inlet pipes 1 and on the connecting webs 2. Since the inlet pipes 1, the connecting webs 2 and the supporting feet 12 integrally molded on them are expediently made of plastic, receptacles 34, preferably made of metal, are inserted into the inside passages 13 of the supporting feet 12 to be able to better accommodate the fastening forces. The receptacles 34 are equipped with a collar 35 projecting radially outward on their end facing the engine block, serving as an abutment or stop when the receptacle 34 is inserted into the inside passage 13. The receptacles 34 are designed with dimensions such that when they are inserted completely into the respective inside passages 13, they project out of the inside passage 13 at their end which faces the holding-down component 32. Plug openings 36 which can be placed on these projecting ends of the receptacles 34 are formed on the holding-down clamps 7. These plug openings 36 are preferably coordinated with these receptacles 34 in such a way as to form a press fit which guarantees automatic mounting of the holding-down component 32 on the receptacles 34 and therefore on the module formed by the inlet pipes 1, the connecting webs 2 and the supporting feet 12. It is thus possible to implement a more advanced form of preassembly, which does not require any additional screws or other detachable fastening means. For this preassembly, the high-pressure inlet line 5 is thus secured on the inlet pipes 1 by the holding-down component 32, whereby the high-pressure inlet line 5 comes to rest in the respective seats 31 and 33. To do so, the holding-down component 32 is preferably first secured on the high-pressure inlet line 5, e.g., by a press fit. Then the module formed by the holding-down component 32 and the high-pressure inlet line 5 is placed on the module consisting of inlet pipes 1, connecting webs 2 and supporting feet 12.

The unit thus preassembled may be mounted on the engine block easily, by screwing the holding-down clamps 7 onto engine block with screws. In doing so, the holding-down clamps 7 at the same time brace the high-pressure inlet line 5 and the inlet pipes 1 against the engine block.

What is claimed is:

1. A piston engine having an engine block which has several cylinders, with a fresh gas inlet having several inlet pipes (1) which are mounted on the engine block and are provided for the cylinders, and having a fuel injection system which has a high-pressure inlet line (5) that is provided for the cylinders, characterized in that holding-down clamps (7) for the inlet pipes (1) are formed on the high-pressure inlet line (5) so that the high-pressure inlet line (5) mounted on the engine block secures the inlet pipes (1) on the engine block.

2. The piston engine according to claim 1, characterized in that the inlet pipes (1) are made of plastic and the high-pressure inlet line (5) is made of metal.

3. The piston engine according to claim 1, characterized in that the holding-down clamps (7) have a retaining ring (8) for each inlet pipe (1) encompassing the inlet pipe (1).

4. The piston engine according to claim 1, characterized in that two adjacent inlet pipes (1) are attached to one another by a connecting web (2), whereby the holding-down clamps (7) have at least one retaining web (11) which extends beyond this connecting web (2).

5. The piston engine according to claim 1, characterized in that supporting feet (12) are designed on the high-pressure inlet line (5) and/or on the holding-down clamps (7), each supporting foot having an inside passage (13) for a screw, whereby the high-pressure inlet line (5) is attached to the engine block by screwing on the supporting feet (12).

6. The piston engine according to claim 5, characterized in that a flange (17) is formed on the inlet pipe (1) on an end facing the engine block, so that at least one of the supporting feet (12) is supported on this flange, said flange (17) containing an opening (30) which is aligned with the inside passage (13) in the supporting foot (12).

7. The piston engine according to claim 6, characterized in that the supporting foot (12) has a supporting plate (14) with which the supporting foot (12) is supported on the flange (17).

8. The piston engine according to claim 6, characterized in that the supporting foot (12) has on the end facing the engine block a cylinder bushing (15) which penetrates into the opening (30) in the flange (17).

9. The piston engine according to claim 1, characterized in that several inlet pipes (1) are combined into one injection molded part.

10. The piston engine according to claim 1, characterized in that the holding-down clamps (7) are designed in one piece with the high-pressure inlet line (5).

11. The piston engine according to claim 1, characterized in that the holding-down clamps (7) and the high-pressure inlet line (5) are designed as separate components.

12. The piston engine according to claim 11, characterized in that several holding-down clamps (7) are combined into a one-piece component (32).

13. The piston engine according to claim 11, characterized in that the holding-down clamps (7) are supported on the high-pressure inlet line (5).

14. The piston engine according to claim 11, characterized in that saddle-shaped seats (31, 33) are formed on the holding-down clamps (7) and/or on the inlet pipes (1), these seats being in contact with the high-pressure inlet line (5) when the latter is mounted, on the engine block.

15. The piston engine according to claim 1, characterized in that each inlet pipe (1) contains a throttle valve (18) the throttle valves (18) are mounted on a common drive shaft (19) in a rotationally fixed manner, the drive shaft (19) has valve sections (23) and bearing sections (24, 25, 26, 27, 28) arranged in alternation in the axial direction, each bearing section (24, 25, 26, 27, 28) has a constant diameter in the axial direction, each bearing section having a different diameter, such that the diameters of the bearing sections increase in the axial direction.

16. The piston engine according to claim 15, characterized in that the smallest diameter of the bearing sections (24, 25, 26, 27, 28) is equal to or greater than the diameter of the adjacent valve section (23) and the diameters of the other bearing sections are greater than the diameters of the valve sections (23).

17. The piston engine according to claim 15, characterized in that the valve sections (23) each have the same diameter.

18. The piston engine according to claim 15, characterized in that a connecting web (2) is formed between adjacent inlet pipes (1), with the drive shaft (19) extending through this web, and with each connecting web (2) having a bearing opening which is designed to be complementary to the respective bearing section (25, 26, 27) of the drive shaft (19).

* * * * *